US005220817A

United States Patent [19]

Wenzel et al.

[11] Patent Number: 5,220,817

[45] Date of Patent: Jun. 22, 1993

[54] SPINNING MACHINE WITH AT LEAST ONE ROLLER HOLDER

[75] Inventors: Helmut Wenzel, Beckum; Karl-Heinz Köstermeier, Rietberg, both of Fed. Rep. of Germany

[73] Assignee: Leifeld GmbH & Co., Ahlen, Fed. Rep. of Germany

[21] Appl. No.: 805,549

[22] Filed: Dec. 10, 1991

[30] Foreign Application Priority Data

Dec. 17, 1990 [DE] Fed. Rep. of Germany ..... 4040300

[51] Int. Cl.[5] ..... B21D 22/00

[52] U.S. Cl. ..... 72/84; 72/83

[58] Field of Search ..... 72/82-85

[56] References Cited

U.S. PATENT DOCUMENTS

| | | | |
|---|---|---|---|
| 4,509,351 | 4/1985 | Rolin et al. | 72/83 |
| 4,565,081 | 1/1986 | Massee | 72/83 |
| 4,747,284 | 5/1988 | Hudson | 72/83 |
| 4,976,126 | 12/1990 | Yamamoto et al. | 72/83 |

FOREIGN PATENT DOCUMENTS

| | | | |
|---|---|---|---|
| 25923 | 11/1984 | Austria . | |
| 0125720 | 11/1984 | European Pat. Off. . | |
| 1173865 | 9/1955 | Fed. Rep. of Germany . | |
| 1958055 | 5/1971 | Fed. Rep. of Germany . | |
| 1542663 | 2/1990 | U.S.S.R. | 72/82 |

*Primary Examiner*—W. Donald Bray

*Attorney, Agent, or Firm*—Felfe & Lynch

[57] ABSTRACT

A metal spinning machine with at least one roller holder, the roller holder being mounted exchangeably on a tool rest system with a roller rotatably borne by it. The tool rest system permits the roller to be displaced in at least two coordinate directions relative to a workpiece to be formed by spinning. The workpiece can be mounted on a rotatable metal spinning machine spindle with a rotationally symmetrical shaping tool. The metal spinning machine is equipped with a means limiting the force which can be exerted by the roller on the workpiece.

The new metal spinning machine is characterized by the fact that the roller holder (1) is made with two holder parts (2, 3) which are slidingly displaceable on one another, one of them being configured as a fixed holder part (2) which can be attached to the tool rest system (4) and the other being configured as the displaceable holding part (3) bearing the roller (10), that the one holder part (3) is made with a cylinder (20) which can be fed a pressure medium, that the other holder part (3) is made with a piston (30) which can be actuated by the pressure medium with a predeterminable force in the extending direction, and that the roller (10) can be pushed back dynamically by an excessive force applied to it by the workpiece (30).

10 Claims, 2 Drawing Sheets

SPINNING MACHINE WITH AT LEAST ONE ROLLER HOLDER

BACKGROUND OF THE INVENTION

Figure 1:
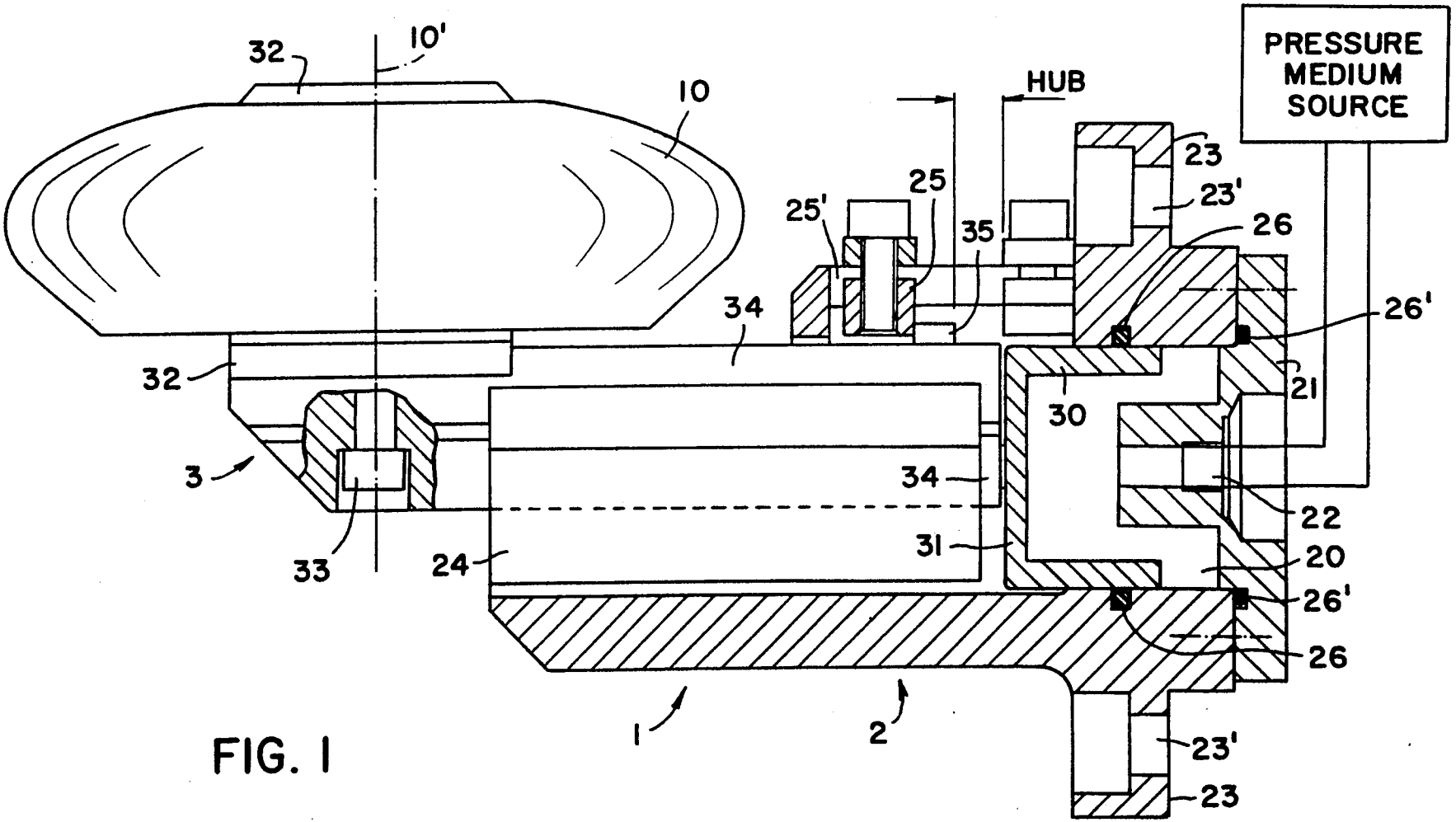

The invention relates to a metal spinning machine in accordance with the introductory part of claim 1.

Metal spinning machines and their corresponding roller holders are known and have long been used for the cold forming of rotationally symmetrical workpieces. The roller holders serve especially for a rapid changeover of the machine from one roller to another. In modern metal spinning machines a plurality of roller holders are usually held in a magazine and can be selectively fastened to the tool rest, and then the selection and mounting as well as removal of the roller holder takes place automatically the same as the spinning process, under the control of a program.

A widely used method for the production of control data for the program is the so-called "playback" method in which first the metal spinning machine is operated by a workman and at the same time the individual steps of the operation and the roller positions they produce are electronically detected and recorded as data. With these recorded data the same working procedure is then repeated as often as desired under the controlling program, with precision and great speed, while the roller successively runs through the recorded positions.

Especially in the case of workpieces of a soft material such as aluminum or copper, when fluctuations or irregularities in the thickness of the blank workpieces occur, operating defects can occur which in the most unfavorable case can result in the parting of the workpiece as a result of excessive tool pressure. To prevent this it is necessary to limit the force exerted by the roller on the workpiece.

European Patent 0 125 720 B1 discloses a metal spinning machine provided with such a force limiting system. In this machine the roller holder is made rigid; but a spring unit is disposed between the top rest of the tool rest unit and the system driving the top rest. While the spinning is in progress, a sensor detects the force exerted through the roller holder and the top support on its drive system, and the force that is detected is substantially the same as the force exerted by the roller on the workpiece. The detected force values are fed to a control unit and under the control of the program the carriage bearing the roller holder is backed off by means of its drive unit if a preset degree of compression of the spring unit is exceeded, or if the said compression is less than the preset degree.

It is considered to be a disadvantage of this method that its technical complexity is very great, because a special top rest with spring unit and sensor is needed, and an expansion of the control program is necessary. Also, there is the disadvantage that the parts to be moved, namely the top support carriage, the roller holder and the roller together constitute a great mass, which results in a relatively low speed of reaction. Since this furthermore involves a control system, an oscillation or resonance can occur in the positioning of the roller, which can be prevented only by damping which reduces the speed of reaction. This machine, therefore, is hardly suitable for fast machining operations.

The problem therefore arises of creating a metal spinning machine of the kind described above, in which an effective and fast-reacting limitation of the force exerted by the roller on the workpiece can be achieved without great complexity and cost, and without the occurrence of oscillation or hunting.

This problem is solved according to the invention by a metal spinning machine of the kind described above, with the distinctive features of claim 1.

With the metal spinning machine according to the invention it is brought about that the force that can be exercised by the roller on the workpiece can be limited in a simple manner to harmless levels by setting an appropriate pressure of the pressure medium. Furthermore, by the use of the piston-and-cylinder arrangement, the force acting on the piston can be kept constant over the entire stroke, i.e., a largely linear characteristic is achieved. Since the moving masses are very small, a very high speed of reaction is assured, which permits a high operating speed. Furthermore, no control system is needed here, which eliminates oscillation and hunting, and renders sensors and other additional control and regulating devices superfluous. The technical cost therefore remains limited, added to the fact that only the roller holder of the spinning machine has to be modified, while all the rest of the parts of the metal spinning machine as well as the control program can be left completely unaltered. Consequently the invention is also suitable for the upgrading of existing metal spinning machines, because only the roller holder needs to be replaced. A compressor or hydraulic pump, for example, is usually already present anyway, so that, aside from any pressure regulating unit that might be necessary, no great additional cost is involved. With the new metal spinning machine, therefore, improved product quality is achieved, without involving great additional cost for the machinery, and without requiring additional working procedures or additional time.

Preferred configurations and further developments of the invention are set forth in the secondary claims.

Figure 2:
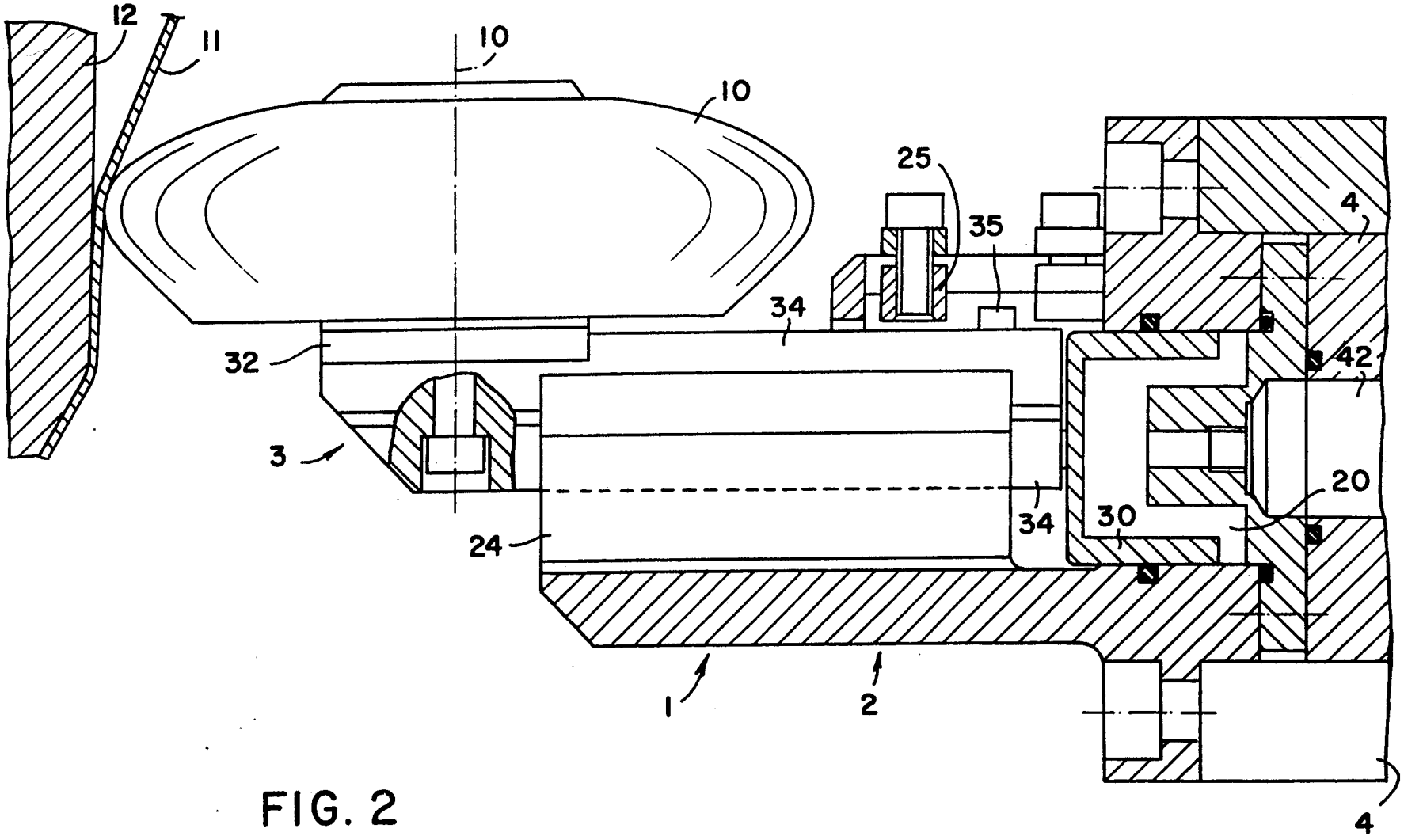

An embodiment of the invention will be explained below with the aid of a drawing. The figures in the drawing are:

FIG. 1 a roller holder in its basic position as part of a metal spinning machine, partially in a side elevation and partially in a longitudinal section, and FIG. 2 the roller holder of FIG. 1 in the working position.

As FIG. 1 of the drawing shows, the embodiment of a roller holder 1 here represented comprises a fixed holder part 2 which can be attached to the tool rest of a metal spinning machine which is not represented here. On its end toward the tool rest, i.e., on the right in FIG. 1, the fixed holder part 2 is formed of a cylinder 20 which is closed off from the tool rest system by a cylinder bottom 21. The cylinder bottom 21 is joined releasably to the rest of the fixed holder part 2 with the interposition of an annular gasket 26', and has a central pressure medium connection 22 in the form of a stepped bore for the entry and exit of a pressure medium. Above and below this cylinder 20 connecting flanges 23 with bores 23' are provided, by means of which the roller holder 1 can be releasably fastened to the tool rest system.

At the end remote from the tool rest system, i.e., at the left end in the drawing, the fixed holder part 2 bears a guide body 24 running lengthwise of the roller holder 1.

A plunger 34 forming part of the displaceable holder part 3 is guided snugly and with low friction in this guide body 24. At its inner end, i.e., the right end in FIG. 1, the plunger 34 is fastened to the face 31 of a piston which is guided in the cylinder 20 with an interposed sealing ring 26. At its outer end, i.e., the left end in the drawing, the plunger 34 bears a roller mounting 32 on which a forming roller 10 is journaled on a shaft 10'. The plunger 34 is attached to the roller mounting 32 by a screw 33 running in the direction of the shaft 10', thus permitting easy replacement of the roller mounting 32 together with the roller 10.

When the interior of cylinder 20 is fed with the pressure medium through the pressure medium connection 22, the piston 30 is biased in the direction of deployment with a force depending on the pressure of the pressure medium. The stroke of the piston 30 and thus also of the plunger 34 and roller 10 is limited by a stop 25 which is situated above the plunger 34 and forms part of the fixed holder part 2. On the top side of the plunger 34 is an abutment 35 which engages the stop 25 when the roller holder 1 is in the basic position shown in FIG. 1. The stop 25 is made adjustable for the establishment of different end limits, a stop holder 25' being provided for this purpose, which runs parallel to the plunger 34 and on which the stop 25 can be shifted after loosening a screw and can be locked again by tightening the screw.

In FIG. 2 of the drawing, the roller holder 1 is shown in a working position in which it is mounted on a tool rest system 4 which is indicated only in part, and in which the roller 10 is thrusting against a workpiece 11 which in turn is rotating together with a rotationally symmetrical chuck 12 for creating the shape of the workpiece. The spindle axis in operations of this kind is usually at an angle between about 20 and 90 degrees from the axis of rotation 10' of the roller 10, which in turn is made to rotate by the rotating chuck 12 and workpiece 11.

It can furthermore be seen in FIG. 2 that in the embodiment here represented the tool rest 4 has an integrated pressure medium line 42 whereby a connection to a supply system for the input and discharge of the pressure medium is automatically produced.

In modern metal spinning machines, a spinning program previously stored by the playback method is repeatedly executed by the machine under the control of an electronic control unit, for which purpose the tool rest system 4, which generally includes a bottom rest as well as a top rest disposed transversely thereof, is operated by means of actuating systems which can be controlled by the control unit such that the roller 10 performs the desired movement along the workpiece 11 and chuck 12. Since this is a positioning control, when the thickness of the workpiece 11 varies or other inaccuracies are encountered, such as can occur due to wear or to errors in setting the basic position, the results of the work can degrade to the extent that the thickness of the workpiece 11 after spinning may be incorrect, or they can even be so great that the workpiece 11 splits apart during the spinning operation. This is prevented in the roller holder 1 by the fact that the force that can be exerted by the roller 10 on the workpiece 11 is limited. The force 11 exerted by the roller 10 on the workpiece is here determined only by the pressure of the pressure medium prevailing in the cylinder 20, which is controllable within wide limits. At the same time the pressure can be kept constant throughout the entire operation, or, if it is desired, can be varied in a controlled manner during the operation.

In the case of different material thicknesses or other mechanical defects in the workpiece 11, which otherwise would affect the force exerted by the roller 10 on the workpiece 11, they are no longer of any importance here, since the roller 10 can yield in and out dynamically with the plunger 34 and the piston 30, and on account of the small masses that have to be moved this motion is a fast-reacting motion, i.e., takes place with very little inertia. Due to the use of the piston-and-cylinder system 20, 30, which can be fed with the pressure medium, a linear characteristic is also achieved, i.e., the force exerted by the roller 10 on the workpiece 11 is to a very great extent independent of the current position of the displaceable holding part 3 with respect to the fixed holder part 2. The pressure medium can be, for example, compressed air or hydraulic fluid, since supplying apparatus and control apparatus are generally available where the metal spinning machines are located anyway for the controlled variation and maintenance of the pressure of these pressure media.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Metal spinning machine comprising: a tool rest system, at least one roller holder, a roller held by the roller holder for rotation on the tool rest system which permits a displacement of the roller in at least two coordinate directions relative to a workpiece to be formed by spinning, a spindle for mounting the workpiece and means for driving the spindle in rotation, a rotationally symmetrical chuck which shapes the workpiece, apparatus limiting force which can be exerted on the workpiece by the roller, the roller holder having two holder parts which are slidingly displaceable against one another, one of which is configured as a fixed holder part which can be fastened to the tool rest system and an other of which is configured as a displaceable holder part bearing the roller, a source of pressure medium kept at a predetermined pressure, the one holder part being configured with a cylinder coupled to the pressure medium source, the other holder part being configured with a piston which can be driven in an extending direction by the pressure medium with a predetermined force corresponding to the predetermined pressure of the the pressure medium, and the roller yielding dynamically and with resilience to a force exerted on the roller by the workpiece and exceeding an extending force of the piston, with displacement of the pressure medium from the cylinder into the pressure medium source which is kept at a predetermined pressure.

2. Metal spinning machine according to claim 1, in which the roller holder has a low-friction, snug-fitting and twist-resistant guide body, a plunger guided in the guide body, the guide body being associated with the fixed holder part and the plunger carried in the guide body being associated with the displaceable holder part, and the plunger serving as a piston rod being joined at its one, inner end to the piston and bearing the roller on its other, outer end.

3. Metal spinning machine according to claim 2, in which the guide body is configured as a roller runner.

4. Metal spinning machine according to claim 1, in which the direction of the two holder parts against one another is substantially perpendicular to an axis of rotation of the roller.

5. Metal spinning machine according to claim 1, which includes a mechanical stop and in which the displacement stroke of the two holder parts against one another is limited by the mechanical stop.

6. Metal spinning machine according to claim 5, in which the stop is adjustable for the adjustment of different maximum strokes.

7. Metal spinning machine according to claim 1, which includes a flexible pressure medium conduit in which the roller holder has a pressure medium connection carried outwardly from the interior of the cylinder and accessible with the roller holder in an installed state, to which connection the flexible pressure medium conduit is attached for the feeding in and removal of the pressure medium.

8. Metal spinning machine according to claim 1, which includes a pressure medium conduit and in which the roller holder has a pressure medium connection carried outwardly from the interior of the cylinder, which when the roller holder is attached to the tool rest system is brought automatically into sealing connection with the pressure medium conduit lying within the tool rest system for the feeding in and removal of the pressure medium.

9. Metal spinning machine according to claim 1, which includes at least one removable and exchangeable spring in which one of the displaceable holder parts is additionally biased by means of the at least one removable and exchangeable spring with a force acting in the extending direction.

10. Metal spinning machine according to claim 9, in which the fixed holder part includes a bottom of the cylinder and in which the spring is disposed in the interior of the cylinder between its bottom and the piston, and in which the cylinder bottom is joined releasably to the rest of the fixed holder part.

* * * * *